US006895701B1

(12) United States Patent
Ocampo et al.

(10) Patent No.: US 6,895,701 B1
(45) Date of Patent: May 24, 2005

(54) STRAINER FRAME FOR MOUNTING ART CANVAS

(76) Inventors: Horacio M. Ocampo, 1700 W. 135th St., Gardena, CA (US) 90249; Stephen R. Dusse, 655 Marunzanita Way, Woodside, CA (US) 94062-1216

( * ) Notice: Subject to any disclaimer, the term of this patent is extended or adjusted under 35 U.S.C. 154(b) by 0 days.

(21) Appl. No.: 10/388,806

(22) Filed: Mar. 17, 2003

(51) Int. Cl.[7] ..... D05C 3/08
(52) U.S. Cl. ..... 38/102.1
(58) Field of Search ..... 38/102, 102.1, 38/102.91, 102.3; 160/378, 379, 381, 392, 371, 374.1, 382, 391, 395, 403; 101/127.1; 40/780, 781, 782, 784, 785, 603; 52/656.1, 656, 656.7, 657

(56) References Cited

U.S. PATENT DOCUMENTS 2,432,889 A * 12/1947 Herrmann ..... 160/90
3,651,854 A * 3/1972 Terna ..... 160/374.1
3,830,278 A * 8/1974 Packer ..... 160/378
3,955,298 A * 5/1976 Kapstad ..... 40/782
3,978,905 A * 9/1976 de Lama et al. ..... 160/378
4,570,406 A * 2/1986 DiFazio ..... 52/656.9
5,237,785 A * 8/1993 Lukes ..... 52/86
5,502,906 A * 4/1996 Yamawaki ..... 38/102
5,918,392 A * 7/1999 Bates ..... 38/102.1
6,347,466 B1 * 2/2002 Lackner et al. ..... 38/102.4

* cited by examiner

*Primary Examiner*—Ismael Izaguirre
(74) *Attorney, Agent, or Firm*—J. E. McTaggart

(57) ABSTRACT

Sturdy metal strainer frames for mounting art canvas are assembled in any required size in an easy and cost-effective fabrication approach. Frame members fabricated as aluminum extrusions are joined at mitred corners to form a rectangular strainer frame. The frame extrusion pattern provides a smooth rounded perimeter edge for improved canvas mounting, a rear channel for anchoring the canvas around the edges and a larger channel around the inside of the frame for accepting brace members as required and holding them accurately aligned, typically at two foot intervals for larger frame sizes. The brace members, provided in two types of extrusion pattern, are cut to length and attached together at junctions as required and to the frame at overlapping flanges, preferably by a proprietary TOX (R) joining system utilizing an upsetting-pressing technique that eliminates all separate fastening hardware items such as clips, nuts, bolts, screws and rivets and requires no drilling, welding, or adhesives.

10 Claims, 4 Drawing Sheets

STRAINER FRAME FOR MOUNTING ART CANVAS

FIELD OF THE INVENTION

The present invention relates to the field of artwork, billboards, posters and the like performed on fabric and other sheet materials that are mounted onto a frame, and more particularly it relates to improved structure of a strainer frame directed to stretch-mounting canvas for artwork such as oil paintings.

BACKGROUND OF THE INVENTION

Frames for mounting canvas art work have been typically made from wood: canvas or other fabric is stretched around the perimeter edges of the frame and fastened in place, typically by stapling, under tension, preferably in two perpendicular directions, so as to provide a uniform plane surface.

High tension is desirable to ensure long life without sagging or wrinkling, however high tension places large loads on the wood frame with a strong twisting force tending to distort the frame and cause loss of tension over time. Quality canvas mounting requires custom milling of specially selected kiln dried wood, and even with frames that have been carefully shaped and smoothed from premium wood material, the wood surface often tends to bind on the canvas and develop friction that interferes with uniform stretching around the edges. Due to these and other shortcomings of the wood frames, the mounting of art canvas on wood frames has continued to represent a difficult task that requires unusual skill and experience to perform satisfactorily, with resulting high cost for labor and materials.

DISCUSSION OF RELATED KNOWN ART

The present patent is directed to strainer frames of fixed dimensions as distinguished from stretcher frames that can be expanded with the canvas/fabric in place, e.g. as disclosed in patent application Ser. No. 10/139,809 disclosing a FABRIC-GRIPPING/STRETCHING SYSTEM filed on May 7, 2002 by Horacio M. Ocampo, one of the present joint inventors, issued as patent U.S. Pat. No. 6,675,510 B2.

OBJECTS OF THE INVENTION

It is a primary object of the present invention to provide an improved structure and assembly method for strainer frames for mounting fabric such as art canvas or similar sheet materials which are to be wrapped around the perimeter and secured in a rear region.

It is a further object that the new structure be cost effective overall.

It is a further object that the new structure be easy to assemble from a minimal number of different component parts.

It is a still further object to totally eliminate all conventional welding and/or hardware items such as rivets, nuts, bolts, and the like in the fabrication of the new frame structure.

It is a still further object that frames constructed in accordance with the present invention be made from material other than wood that will provide a lower coefficient of friction than wood and thus reduce drag between the tensioned fabric and the peripheral surface of the frame.

SUMMARY OF THE INVENTION

The abovementioned objects have been accomplished by the present invention of sturdy metal strainer frames for mounting art canvas that can be assembled in any required size in an easy and inexpensive fabrication approach. Frame members fabricated as aluminum extrusions are readily joined at mitred corners to form a rectangular strainer frame. The frame extrusion pattern provides a smooth rounded perimeter edge for improved canvas mounting, a rear channel for anchoring the canvas around the edges and a larger channel around the inside of the frame for accepting brace members as required and holding them accurately aligned, typically at two foot intervals, for larger frame sizes. The brace members, provided in two types of extrusion pattern, are cut to length and attached together at junctions and to the frame members at overlapping flanges by a proprietary TOX (R) joining system utilizing an upsetting-pressing technique that eliminates all welding and fastenings such as clips, nuts, bolts, screws and rivets.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
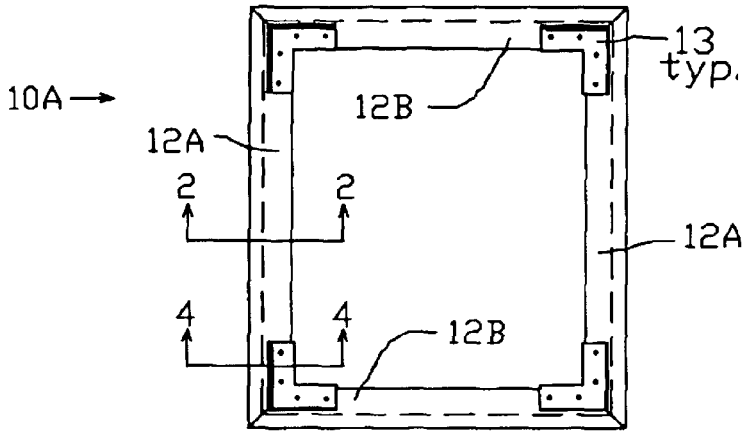
FIG. 1 is a plan view of an unbraced embodiment of the strainer frame of the present invention.

In FIG. 1 depicts a basic embodiment of the present invention: a rectangular strainer frame 10A fabricated with two pairs of frame members 12A and 12B extruded from aluminum and angle-cut to required length with mitred corners as shown, each reinforced with a metal corner member 13. This basic form of construction, with no transverse brace members, is suitable for a small strainer frame 10A not exceeding about 2 feet in either dimension.

Figure 2:
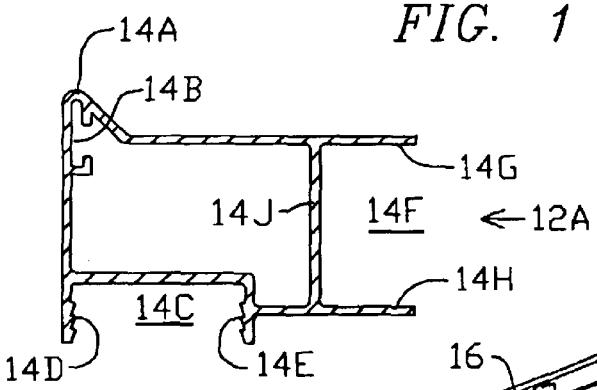
FIG. 2 is a cross-section of a frame member taken through axis 2—2 of FIG. 1 and enlarged.

FIG. 2 is a cross-section of frame member 12A, taken through axis 2—2 of FIG. 1 and enlarged, shows the extrusion pattern utilized in all frame members of the various embodiments of the invention. A smoothly rounded corner 14A with 0.080" radius is configured to provide the principal canvas support rim around the frame perimeter. On the inside of corner 14A, an internal channel 14B is formed to accept a corner-aligning right-angle bracket. A larger channel 14C is configured at the rear exterior with opposing barbed walls 14D and 14E for retaining a fabric-gripping filler. A still larger exterior channel 14F is formed by the two parallel flanges 14G and 14H extending to th right from the transverse web 14J as shown. Typically, the frame extrusion pattern is made approximately 1.45 inches by 2 inches overall with wall thickness of 0.0620" except for flanges 14G and 14H which are made 0.0500" thick.

Figure 3:
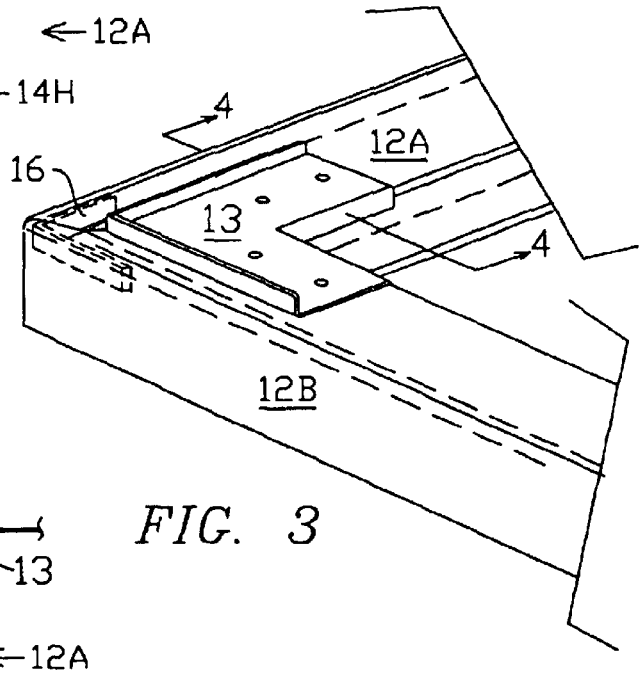
FIG. 3 is an enlarged perspective view showing structure of a typical corner of the strainer frame of FIG. 1.

FIG. 3 is an enlarged perspective view of a typical corner of the strainer frame 10A of FIG. 1, showing side member 12A joining bottom member 12B at a mitred corner. A metal corner-aligning right-angle bracket 16, located internally in channel 14B (FIG. 2), indicated in broken lines, along with corner member 13 which is formed from sheet metal to have inner and outer edge flanges as shown and each fastened to the channel members 12A and 12B in four places, serve to establish and maintain accurate corner alignment and prevent skewing.

Figure 4:
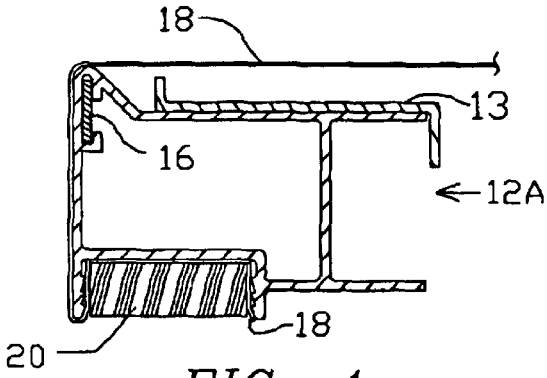
FIG. 4 is an enlarged cross-section of a frame member such as at 2—2 of FIGS. 1 and 3, showing a portion of an art canvas mounted thereto.

FIG. 4 shows a cross-section taken thru 4—4 of FIGS. 1 and 3: the cross-section of frame member 12A is identical with that at 2—2 of FIG. 1 as shown in FIG. 2, however FIG. 4 includes corner member 13, with two formed edge flanges as shown, and showing frame member 12A as normally deployed with the addition of an edge portion of art canvas 18 mounted in place, wrapping around the frame member 12A and wedged in place in channel 14C (FIG. 2) by insertion of a gripping filler 20, made from a suitable resilient material such as wood or paper-wrapped foam, around the frame perimeter. The insertion of filler 20 sets up tensile strain in the canvas 18 as it is held in a flat plane by the raised edges 14A (FIG. 2). Pressure from the opposed pair of barbed walls 14D and 14E (FIG. 2) holds filler 20 firmly in place. Art canvas 18 is available pre-stretched, and is originally provided slightly larger than required, the extending surplus border being trimmed off after mounting.

For the aluminum perimeter frame extrusion of the size and configuration shown in FIGS. 2 and 4, it is recommended that cross-brace support should be provided at approximately 2 feet intervals. Thus, the unbraced strainer frame of FIG. 1 is suitable for sizes up to a square 2 feet per side, beyond which one or more cross-brace members should be provided to avoid frame deformation due to the loading of the canvas tension.

Figure 5:
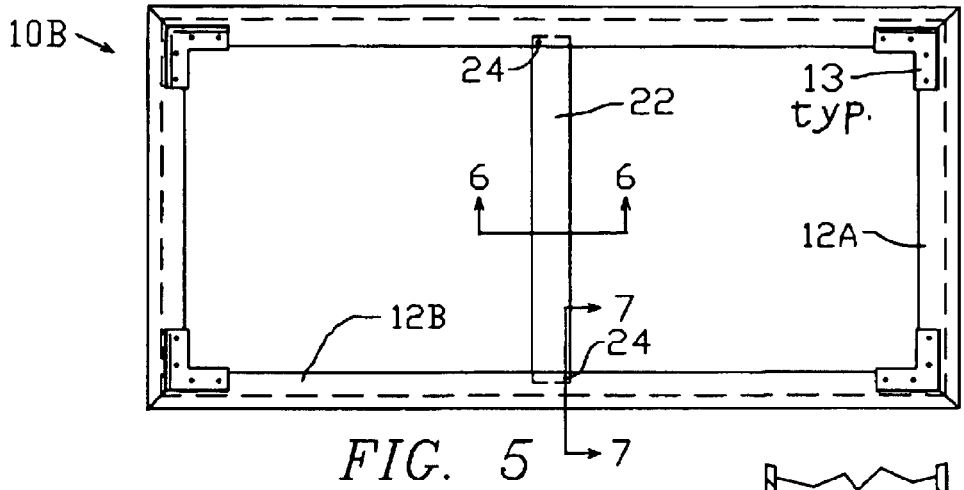
FIG. 5 is a plan view of a single-braced embodiment of the strainer frame of the present invention configured with a brace member of a first type.

FIG. 5 is a plan view of a strainer frame 10B in a single-braced embodiment of the present invention configured with a brace member 18 of a first type (type 1) extending across the minor dimension of the rectangular frame 10B, wherein the short frame members 12A are under 2 feet and the long frame members 12B are between 2 and 4 feet in length. Brace member 22 is dimensioned to fit into the main channel between the flanges of the frame members.

In the overlapping regions of the frame members 12B with corner members 13 and with brace member 22 the two interfacing layers of metal are permanently joined together by a special type of fastening joint 24, typically with four joints 24 in corner members 13 as shown and two places at each end of brace member 22, one at the front of frame 10B as shown and one at the rear, is not shown. Each joint 24 is formed in an upsetting/pressing operation by a special tool manufactured and supplied by Pressotechnik Joining Systems of Germany under the trademark TOX; this fastening system eliminates all conventional fastening hardware such as clips, screws and rivets, and requires no drilling or welding.

Figure 6:
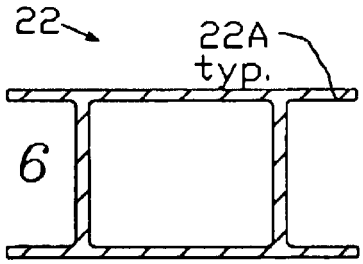
FIG. 6 is a cross-section of the brace member of FIG. 5 taken at axis 6—6.

FIG. 6 is a cross-section of the type 1 extrusion pattern of brace member 22, taken through axis 6—6 of FIG. 5. This H-shaped pattern is configured with four extending flanges 22A, and is made 0.9200" in total thickness to fit into a 0.9227" spacing between the parallel flanges 14G and 14H (FIG. 2) that extend inwardly from the frame members.

Figure 7:
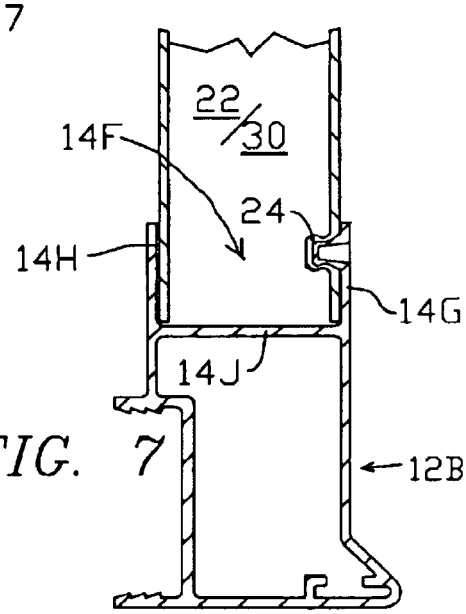
FIG. 7 is a cross-section of an intersection of the brace member with the lower frame member of FIGS. 5 and 9 taken at axis 7—7.

FIG. 7 is a cross-section taken through 7—7 of FIG. 5 at the a typical intersection, in this case the inverted-T-shaped intersection between frame member 12B and brace member 22 which is seen extending into the major channel 14F (FIG. 2) where, constrained by flanges 14G and 14H, it extends inwardly to the transverse web 14J. The overlapping flanges are fastened by TOX joint 24.

Figure 8A:
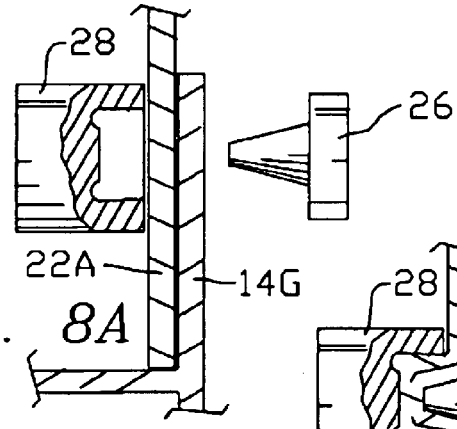
FIGS. 8A, 8B and 8C are cutaway enlarged side views illustrating the punch process of the TOX (R) fastening as shown in FIG. 7.
Figure 8B:
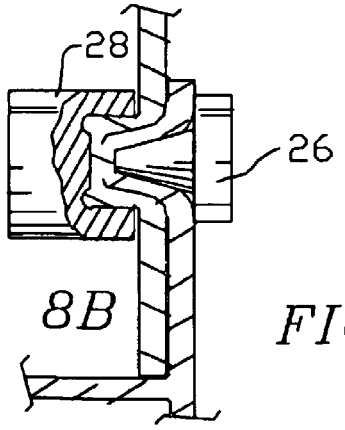
Figure 8C:
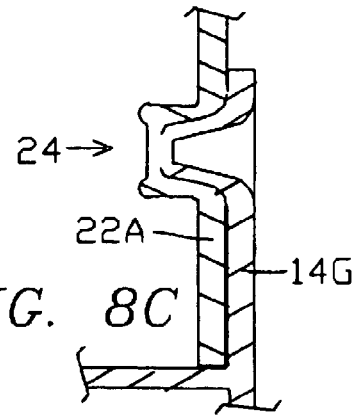

FIG. 8A is a enlarged cutaway side view showing in cross-section two overlapping extruded aluminum flanges 14G and 22A to be joined; they are placed between a coaxial tapered punch part 26 and a mating cavity part 28, the two main components deployed in the jaws of the TOX tool, which can be hydraulicly or pneumatically powered.

FIG. 5B shows the aluminum material displaced and formed into the shape of TOX cavity part 28 by pressure from TOX punch part 26.

FIG. 5C shows the finished circular joint 24 with the TOX tool removed: the two flanges 14G and 22A are permanently joined by the TOX upsetting/pressing operation with no drilling, welding or fastening hardware required. The resulting is reported to exhibit equal strength stress for both shear stress and pull stress and greater strength statically and dynamically than spot welding.

Figure 9:
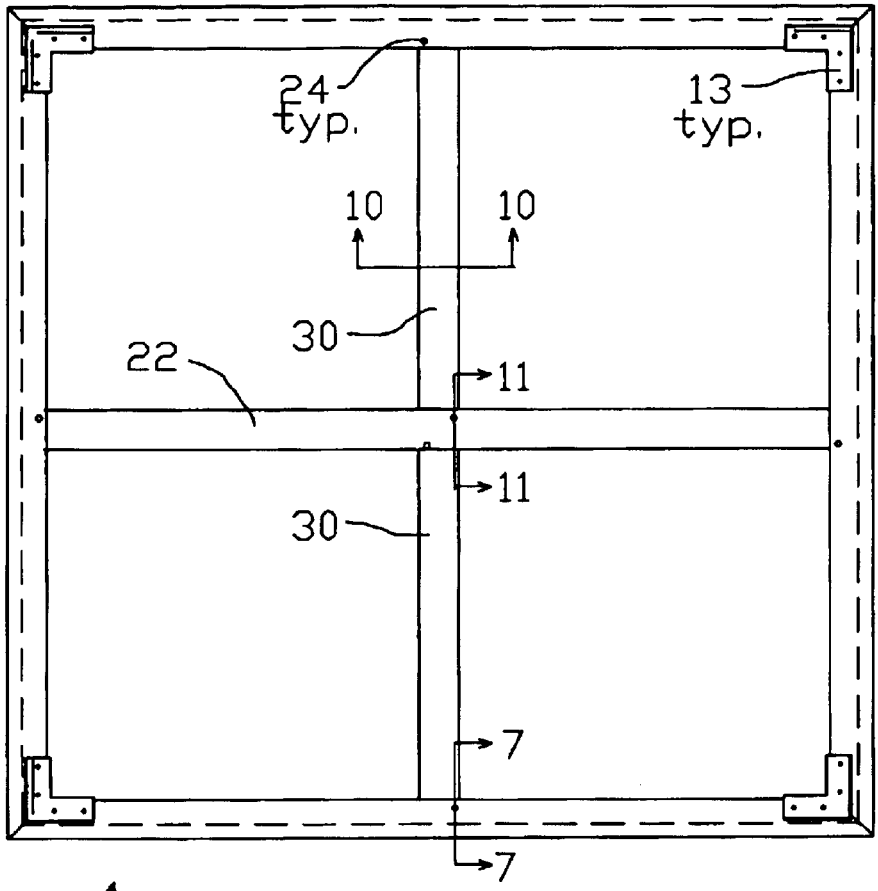
FIG. 9 is a plan view of a double-braced embodiment of the strainer frame of the present invention configured with three brace members: one type 1 full-span brace member intersecting perpendicularly with two type 2 half-span brace members.

FIG. 9 is a plan view of a strainer frame 10C in a double-braced embodiment of the present invention, for the next larger range of frame size up to a square 4 feet per side, configured with four corner members 13 and three brace members: a full-span brace member 22, type 1 as described above, intersecting perpendicularly with a pair of half-span brace members 30 of a second type designated type 2.

Figure 10:
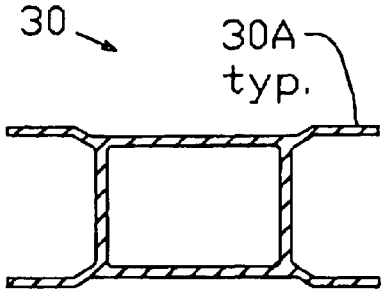
FIG. 10 is a cross-section of the type 2 brace member of FIG. 9 taken at axis 10—10.

FIG. 10 is a cross-section of the type 2 extrusion pattern of brace member 30 taken at axis 10—10 of FIG. 9; it is formed with the same 0.9200" total thickness as type 1 so as to similarly fit into the 0.9227" flange spacing of the perimeter frame members 12A/B. However, for the type 2 half-span brace member 30 to fit the into the 0.8200" flange spacing of a type 1 full span brace member 22, one end of each half-span brace member 30 must be reformed in a press to compress it from its original 0.9200" thickness to 0.8200". To facilitate such end-reforming, the type 2 extrusion pattern is configured in the "spider" shape as shown, with the four flanges 30A offset outwardly.

Figure 11:
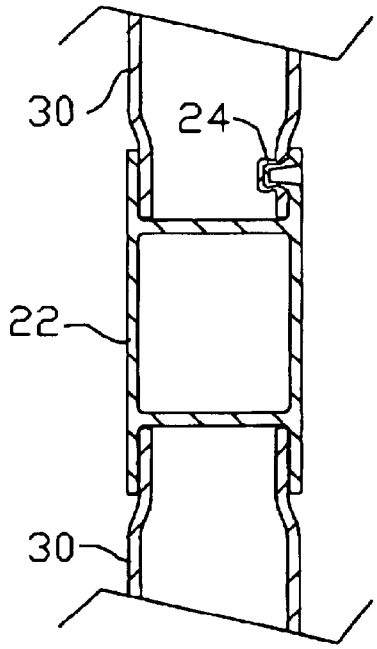
FIG. 11 is a cross section of the central brace member intersection of FIG. 9 taken at axis 11—11.

FIG. 11 is a cross-section of the central X-shaped intersection of full-span brace member 22 (type 1) and a pair of half-span brace members 30 (type 2). The flange reformation at one end of each half-span member 30 is apparent at the central junction. The intersection of one of the half-span brace members 30 with frame member 12B, taken through axis 11—11 of FIG. 9, is shown in FIG. 7.

Figure 12:
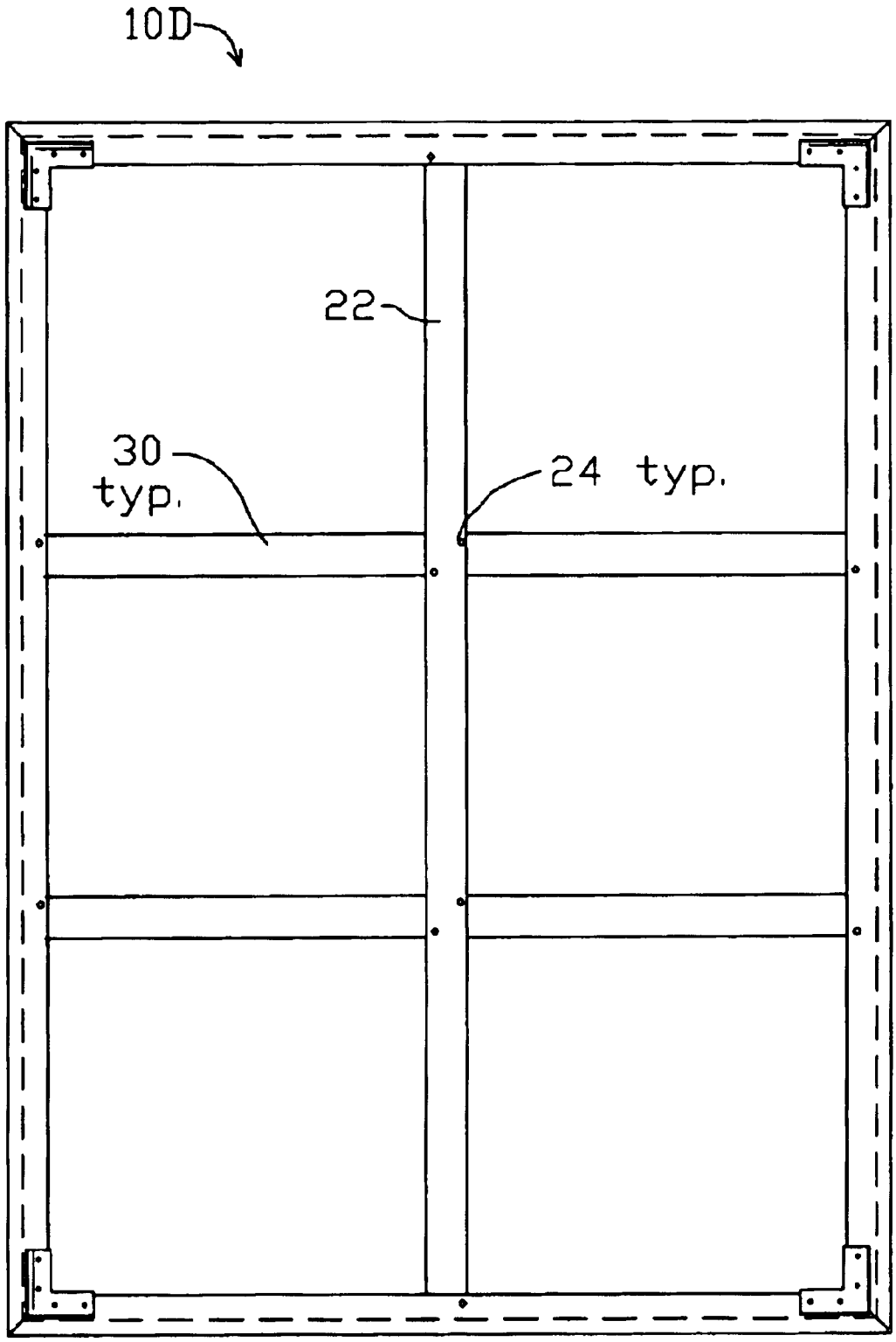
FIG. 12 is a plan view of a triple-braced embodiment of the strainer frame of the present invention configured with five brace members: one of type 1 and four of type 2.

FIG. 12 is a plan view of a strainer frame in a triple-braced embodiment of the present invention configured with five brace members: one full-span brace member 22 (type 1) and four half-span members 30 (type 2), for the next larger range of frame size up to 4 feet by 6 feet.

The size of the strainer frame of the present invention can be further increased indefinitely adding full-span and half-span brace members as required to provide bracing at additional two foot increments, as described above.

In an alternative approach, regarding the configuration of the extrusion patterns of the brace members, a "type 3" full-span brace member is configured with a "spider" extrusion pattern having 1.0227" thickness and 0.9227" flange spacing, i.e. the same as for the peripheral frame members 12A and 12B. While this requires reforming both ends of the full-span brace member to 0.9200" to fit into the frame channels, none of the half-span brace member ends require reforming, since type 1, 0.9200" thick, fits similarly at both ends. The number of end reforms required with type 2 and with the alternative type 3 full-span brace members is tabulated as follows:

TABLE 1

| | | | | End-reforms required | |
|---|---|---|---|---|---|
| Braces | Full | Part | Max size | Type 2 | or Type 3 |
| 0 (FIG. 1) | 0 | 0 | 2' × 2' | 0 | 0 |
| 1 (FIG. 5) | 1 | 0 | 2' × 4' | 0 | 0 |
| 1 | 2 | 0 | 2' × 6' | 0 | 0 |
| 2 (FIG. 9) | 1 | 2 | 4' × 4' | 2 | 2 |
| 3 (FIG. 12) | 1 | 4 | 4' × 6' | 4 | 2 |
| 4 | 1 | 6 | 4' × 8' | 6 | 2 |
| 4 | 1 | 8 | 4' × 10' | 8 | 2 |
| 4 | 2 | 6 | 6' × 6' | 8 | 4 |
| 5 | 2 | 9 | 6" × 8' | 12 | 4 |
| 6 | 2 | 12 | 6' × 10' | 16 | 4 |

While th foregoing descriptions have described the invention as deployed to mount art canvas, it can be practiced with practically any type of fabric and with other sheet materials such as plastic and random fibre sheets.

Extruded aluminum has been found most suitable for extruding in the three patterns required and for the end-reforming as required on the type 2 brace member; however there are other metals and plastics that could be utilized, and other forming methods such as molding instead of extruding to configure members with which the invention may be practiced.

The use of the TOX fastening system is believed to be most cost effective for fastening the members of the strainer frame, however the invention could be made and practiced by welding, drilling, utilizing alternate known fastening hardware such as screws, nuts and bolts, rivets, eyelets and/or adhesives. Since the TOX fastening system requires sufficient clearance allowance for the associated tool, this imposes a limitation on the minimum thickness of the strainer frame, particularly when all joints on both sides of the strainer frame are implemented with TOX fastenings. A thinner overall frame size may be accomplished while retaining substantial benefit from the TOX fastening system by designing the extrusions to utilize an optimal combination of TOX and known hardware: e.g. TOX on the joints on one side of the frame and known fastening hardware on the other side of the frame along with gussets or other support structure as required.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A strainer frame for supporting and tensioning a sheet of material such as art canvas, comprising:

two pairs of frame members, each member being having a cross-sectional shape defined by an extrusion pattern configured with a planar outside edge, a front side configured with a planar portion and a forward raised rim for canvas support adjacent the outside edge, a rear side configured with a planar portion and a longitudinal channel for retaining a canvas-anchoring filler, an inner edge configured with a parallel pair of longitudinal flanges extending inwardly and providing there between a brace-mounting channel, and both ends angled at 45 degrees, the ends being joined together so as to form a rectangular frame with four mitred corners, and at least one brace member made and arranged to brace at least one corresponding attached frame member against deformation inwardly toward each other due to canvas strain, wherein the brace member is configured with flange regions that overlap and interface the flanges of the corresponding frame member, the brace member being attached to the corresponding frame member in the overlapping flange regions by attachment means for joining together the overlapping flange regions.

2. The strainer frame as defined in claim 1 wherein the extrusion pattern is further configured with a web extending between the front side and the rear side, defining a bottom wall of the brace-mounting channel thus formed between the parallel pair of longitudinal flanges.

3. The strainer frame as defined in claim 2 further comprising an elongate full-span brace member extending between a pair of the frame members and extending into the brace-mounting channel of each member of the pair, and attached thereto, so as to brace the two attached frame members against deformation inwardly toward each other due to canvas strain.

4. The strainer frame as defined in claim 3 further comprising at least one pair of elongate half-span brace members each extending perpendicularly in opposite directions from the full-span brace member to the brace mounting channel of a corresponding frame member and attached thereto, so as to brace all four frame members against deformation inwardly toward each other due to canvas strain.

5. The strainer frame as defined in claim 1 wherein the attachment means comprises a region compressed together and united by an upsetting/pressing operation by an upsetting-pressing tool that fastens the interfacing and overlapping flanges together in a secure and permanent manner without drilling, welding or requiring additional fastening hardware.

6. The strainer frame as defined in claim 1 wherein said strainer frame further comprises at least four right-angled corner brackets deployed in a manner to ensure corner alignment between the four frame members; and four of said right-angled corner brackets are configured from sheet metal as two similar coplanar strip portions mutually perpendicular and formed integrally in a general L shape, fastened against the front side of the frame members, one bracket in each of four corners of the frame.

7. The strainer frame as defined in claim 6 wherein, in said strainer, the extrusion pattern is further configured to provide a channel, located in a region near the raised rim, configured and arranged to accept a corresponding one of the four corner brackets.

8. The strainer frame as defined in claim 6 wherein each of said right-angled brackets is further formed to provide a first stiffening flange extending forward at an outer edge thereof and a second stiffening flange extending rearwardly at an inner edge thereof.

9. A strainer frame for supporting and tensioning a sheet of material such as art canvas, comprising:

two pairs of frame members, each member being having a cross-sectional shape defined by an extrusion pattern configured with a planar outside edge, a front side configured with a planar portion and a forward raised rim for canvas support adjacent the outside edge, a rear side configured with a planar portion and a longitudinal channel for retaining a canvas-anchoring filler, and an inner edge configured with a parallel pair of longitudinal flanges extending inwardly and providing there between a brace-mounting channel; and an elongate full-span brace member extending between a pair of the frame members and extending into the brace-mounting channel of each member of the pair, and attached thereto, so as to brace the two attached frame members against deformation inwardly toward each other due to canvas strain, said elongate full-span brace member being made to have a cross-sectional shape defined by an extrusion pattern of a first type configured as a hollow rectangular central column with two opposite sides extended to form four similar flanges of designated thickness arranged in an H shape, the brace member being dimensioned to have a total thickness between outer surfaces of the flanges made to fit into the brace-mounting channels formed between inner surfaces of the flanges on the frame members.

10. The strainer frame as defined in claim 9 wherein said elongate half-span brace member is made to have a cross-sectional shape defined by an extrusion pattern of a second type having generally an H shape similar to that of the first type, but differing from the first type extrusion pattern in that the hollow central column is made smaller in height to approximate spacing between inward-facing surfaces of the flanges of the first type extrusion pattern while the four flanges of the second type extrusion pattern are equally offset to make the overall height of the half-span brace members substantially the same as that of the full-span brace members, the half-span brace member being further configured to a reduced height at one end thereof to fit between the flanges of a full-span brace.

* * * * *